United States Patent [19]

Ohannesian et al.

[11] 4,432,568

[45] Feb. 21, 1984

[54] HOUSING FOR GARBAGE DISPOSER

[75] Inventors: Doru A. Ohannesian, Whittier; Cyral M. Walsh, Los Angeles, both of Calif.

[73] Assignee: Norris Industries, Inc., Los Angeles, Calif.

[21] Appl. No.: 297,576

[22] Filed: Aug. 31, 1981

[51] Int. Cl.[3] ..... F16L 35/00

[52] U.S. Cl. ..... 285/3; 285/49; 285/150; 241/100.5

[58] Field of Search ..... 285/3, 49, 4, 159, 150; 241/100.5, 46 W, 257 G; 4/DIG. 4

[56] References Cited

U.S. PATENT DOCUMENTS

| | | | |
|---|---|---|---|
| 2,951,650 | 9/1960 | Gould | 241/257 G |
| 2,965,318 | 12/1960 | Jordan | 241/257 G |
| 3,163,369 | 12/1964 | Hogue | 241/257 G |
| 3,470,893 | 10/1969 | Nelson | 285/3 X |
| 4,135,258 | 1/1979 | Braga et al. | 241/46 W |

*Primary Examiner*—Dave W. Arola

*Attorney, Agent, or Firm*—Harris, Kern, Wallen & Tinsley

[57] ABSTRACT

A garbage disposer for mounting under a sink and adapted for optional connection with a dishwasher drain line. An upper housing for a garbage disposer with a sink inlet passage and dishwasher inlet spout disposed in vertical parallel alignment, with an integral cap for the spout closing the inlet end thereof, which cap is readily removed when a dishwasher is to be operated with the garbage disposer.

2 Claims, 3 Drawing Figures

HOUSING FOR GARBAGE DISPOSER

BACKGROUND OF THE INVENTION

This invention relates to garbage disposers and in particular, to a new and improved upper housing for a garbage disposer.

A garbage disposer typically is mounted under the sink, with the upper housing of the disposer connected to the sink flange by a hush cushion. Often a dishwasher is installed adjacent the garbage disposer and it is desired to connect the dishwasher drain line to the grind chamber of the garbage disposer so that debris from the dishwasher will pass through the garbage disposer before entering the drain to the sewer.

In the past, a conventional upper housing for a garbage disposer is made as a casting, typically aluminum, and is provided with a large sink inlet passage at the top. A smaller lateral passage is also provided in the upper housing for connection to the line from the dishwasher. This passage is perpendicular to the sink inlet passage and is closed with a knockout type plug. This knockout plug serves to seal the dishwasher inlet line or spout.

At the time of installation of the garbage disposer, if a dishwasher is also to be used, this plug is knocked out with a screwdriver and hammer, and the flexible line from the dishwasher is connected to the spout. If no dishwasher is to be used, the plug is left in place so that there is no leakage from the grind chamber.

While this design has been satisfactory for use with castings, new processes for forming housings are being used, including stamping processes, and the conventional design for the upper housing is not particularly suited to such processes. Also, it is desirable to form the garbage disposer components defining the grind chamber of more durable materials and some of these materials are not adapted to casting procedures.

Accordingly, it is an object of the present invention to provide a new an improved upper housing for a garbage disposer which can be produced by a casting or stamping. It is another object of the invention to provide such an upper housing having a large sink inlet passage and a small dishwasher inlet spout with the sink inlet passage and the dishwasher inlet spout disposed parallel to each other. An additional object is to provide such a housing with the spout having an integrally formed cap closing the inlet end of the spout, thereby providing the option of use with and without a dishwasher, with the cap positioned so that it can be removed by cutting or sawing rather than having to be shattered with a punch or screwdriver.

Other objects, advantages, features and results will more fully appear in the course of the following description.

SUMMARY OF THE INVENTION

The present invention is directed to an upper housing for a garbage disposer which is adapted for mounting with a lower housing to provide a grind chamber. The upper housing has a relatively large sink inlet passage and a relatively small dishwasher inlet spout, with the sink inlet passage and dishwasher spout disposed parallel to each other, and with the spout including an integral cap closing the inlet end thereof. In the preferred embodiment, the cap has an end and an annular rim showing the end to the spout, and the thickness of the cap is about one-half the thickness of the spout.

DESCRIPTION OF THE PREFERRED EMBODIMENT

Figure 1:
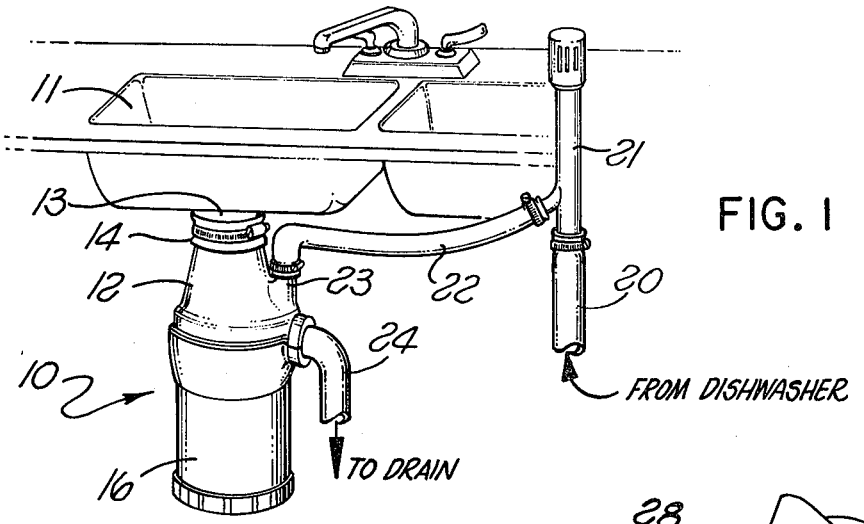
FIG. 1 is a perspective view illustrating the installation of a garbage disposer incorporating the presently preferred embodiment of the invention.

A typical installation for a garbage disposer 10 is illustrated in FIG. 1. The disposer 10 is positioned under a sink 11, with the upper housing 12 of the disposer attached to the sink flange 13 by a hush cushion 14. A motor assembly 16 is suspended from a lower housing 25, with the upper and lower housings joined to form the grind chamber. A dishwasher may be connected to the garbage disposer via a flexible line 20, a ventilating shaft 21 mounted in the sink, and another flexible line 22, with the line 22 mounted on a spout 23 of the upper housing 12. An outlet pipe 24 leads from the disposer 10 to a drain line and thus to the sewer.

The configuration of FIG. 1 is conventional except for the configuration of the upper housing 12 and the positioning of the line 22. In operation, water and scraps from the sink flow into the housing 12 through the inlet 28. In a grind chamber, the scraps are comminuted into small pieces and leave the garbage disposer through the line 24. When the dishwasher is operating, waste water and scraps from the dishwasher flow through the lines 20 and 22 into the grind chamber of the housing 12 through the spout 23.

Figure 2:
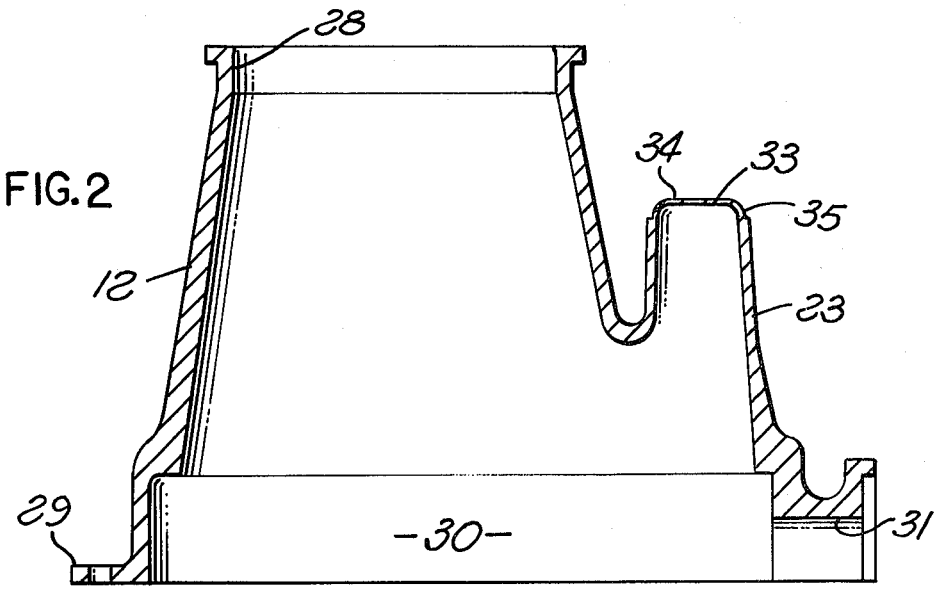
FIG. 2 is an enlarged vertical sectional view of the upper housing of the garbage disposer of FIG. 1, with no dishwasher attached.

The upper housing 12 is shown in greater detail in FIG. 2 in the configuration for use without the dishwasher. This unit may be formed by molding or casting, but preferably is formed by a stamping operation. The housing 12 has a relatively large sink inlet passage 28 and a relatively small dishwasher inlet or spout 23, with these two passages substantially parallel to each other. A peripheral flange 29 at the bottom of the housing 12 provides for attachment to the lower housing 25. The grind chamber 30 in the lower portion of the upper housing 12 communicates with an outlet passage 31 which connects with the outlet line 24. Typically the upper portion of the outlet passage 31 is formed in the upper housing and the lower portion of the passage 31 is formed in the lower housing.

A cap 33 is formed integrally with the spout 23, closing the inlet end of the spout. This cap preferably has a reduced wall thickness as compared to the spout, and desirably has a thickness about one half that of the spout wall. Also, the cap preferably has an end 34 and an annular rim 35, with the rim joining the end to the spout.

The garbage disposer is assembled at the factory with the housing having the configuration of FIG. 2. Then if the disposer is to be installed without a dishwasher, installation is carried out in the normal manner. The cap 33 is not disturbed and closes the spout 23 so that there is no leakage or splashing through the spout.

Figure 3:
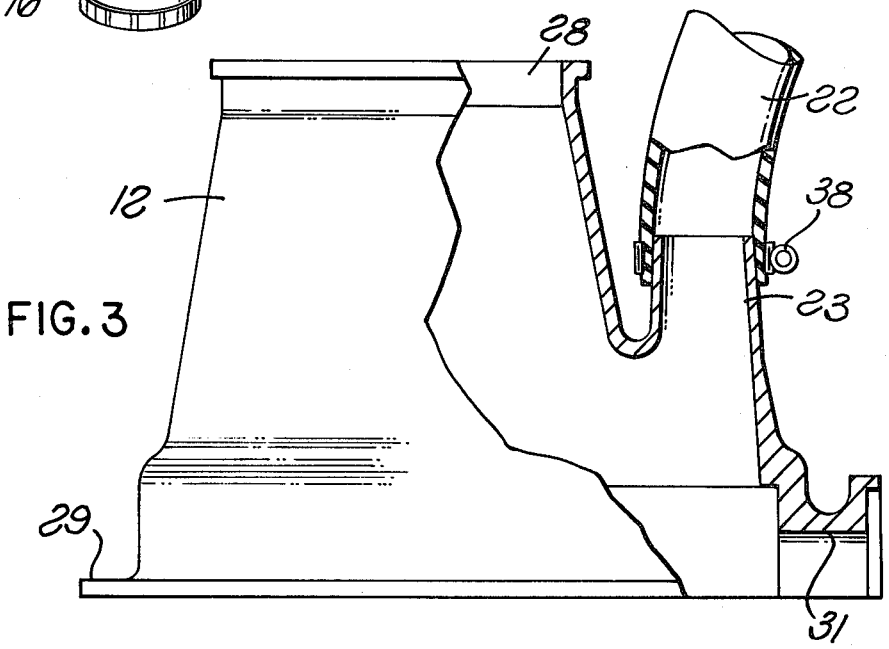
FIG. 3 is a view similar to that of FIG. 2 with a dishwasher drain line attached to the housing.

However if a dishwasher is also being used, the cap 33 is removed, typically by cutting with a knife or with a saw. Then the line 22 is placed over the spout 23, as shown in FIG. 3, and may be held in place by a conventional clamp 38. Thus it is seen that the upper housing 12 provides a larger sink inlet passage and a smaller dishwasher inlet passage with the passages providing parallel flow paths in the vertical direction, with both passages leading into the grind chamber. Also, the upper housing configuration provides for an integral cap for closing the dishwasher inlet passage, which cap is readily removed using hand tools at the site of installation. Further, with this inlet passage configuration, the housing is readily adapted to various manufacturing procedures, including stamping, molding and casting.

We claim:

1. An open upper housing for a garbage disposer and adapted for mounting with a lower housing to provide a grind chamber, said upper housing having an open bottom and means defining a relatively large sink inlet passage and a relatively small dishwasher inlet spout, with said sink inlet passage and said dishwasher inlet spout upwardly directed and disposed parallel to each other, and with said spout including an integral cap closing the inlet end of said spout, said cap having an integral end and an annular rim joining said end to said spout, with said cap end and rim having a reduced wall thickness with respect to said spout.

2. An upper housing as defined in claim 1 with the thickness of said cap about one half thickness of said spout.

* * * * *